US009551159B2

(12) United States Patent
Hutchison et al.

(10) Patent No.: US 9,551,159 B2
(45) Date of Patent: Jan. 24, 2017

(54) BOARD-FREE ROOF JACK CLIP AND METHOD OF USE

(71) Applicants: Jeffrey R. Hutchison, Steubenville, OH (US); Jeffrey W. Hutchison, Amsterdam, OH (US)

(72) Inventors: Jeffrey R. Hutchison, Steubenville, OH (US); Jeffrey W. Hutchison, Amsterdam, OH (US)

( * ) Notice: Subject to any disclaimer, the term of this patent is extended or adjusted under 35 U.S.C. 154(b) by 0 days.

(21) Appl. No.: 14/882,328

(22) Filed: Oct. 13, 2015

(65) Prior Publication Data

US 2016/0138283 A1 May 19, 2016

Related U.S. Application Data

(60) Provisional application No. 62/062,809, filed on Oct. 10, 2014.

(51) Int. Cl.
*E04G 3/26* (2006.01)
*A63B 27/00* (2006.01)

(52) U.S. Cl.
CPC ..... *E04G 3/26* (2013.01); *A63B 27/00* (2013.01)

(58) Field of Classification Search
CPC ..... E04G 3/26; E04G 21/3214; E04G 5/041; B25C 11/00; B66F 15/00
See application file for complete search history.

(56) References Cited

U.S. PATENT DOCUMENTS

| | | | | | |
|---|---|---|---|---|---|
| 1,722,762 | A * | 7/1929 | Othick | E04G 3/26 | 248/237 |
| 4,380,301 | A * | 4/1983 | Eisman | B65D 1/48 | 184/106 |
| 5,322,264 | A * | 6/1994 | Giambro | B25C 11/00 | 254/25 |
| 5,896,607 | A * | 4/1999 | Hagen | B25C 11/00 | 7/144 |
| 6,079,696 | A * | 6/2000 | Bette | E04F 21/0023 | 254/131 |
| D506,118 | S * | 6/2005 | Rau | D8/89 | |

* cited by examiner

*Primary Examiner* — Rodney Mintz
*Assistant Examiner* — Daniel Kenny
(74) *Attorney, Agent, or Firm* — Gary P. Topolosky

(57) ABSTRACT

A quick connect metal roof jack clip that releasably attaches between adjacent roof boards for holding a worker on the roof without the need for any typical jack cross boards or planks. The quick connect clip comprises a plurality of folds for inserting between the boards, flipping down into place and standing thereon before easy flip up, removal and reinsertion into another roof shingle removal and/or installation location.

3 Claims, 4 Drawing Sheets

BOARD-FREE ROOF JACK CLIP AND METHOD OF USE

CROSS-REFERENCE TO RELATED APPLICATIONS

This is a perfection of Provisional Application Ser. No. 62/062,809, filed on Oct. 10, 2014, the disclosure of which is fully incorporated by reference herein.

FIELD OF THE INVENTION

This invention pertains to equipment used by roofers and roof installers. More particularly, it relates to safety equipment for those working on the inclines of a sloped roof (residential or commercial) for the removal of an old roof surface and installation of a new roof thereon.

Roof jacks are typically used on pitched roofs to provide a temporary relatively horizontal platform for standing, placing equipment and/or supplies. One known prior art roof jack is shown in U.S. Pat. No. 6,715,254. In a typical use scenario, two or more roof jacks are attached to a pitched roof at substantially the same vertical height. These two roof jacks are then interconnected with a board or other horizontal member to form a generally horizontal platform. Unfortunately, when the area about the first arranged platform is completed, the workers must remove the first set up and move it to a second location. For a typical old roof removal, that may mean tens or possibly a hundred plus roof jack relocations depending on overall roof size.

The standard method of attachment for the aforesaid roof jacks is to drive a nail or screw into a rafter (or other suitable underlying structure) through one of the grooves in the roof jack provided for this purpose. It is common to place shingles over the top portion of the temporarily installed roof jack (approximately from horizontal member 002, upward), covering the nail or screw. It is also common to temporarily install roof jacks beneath existing shingles, which requires bending back the existing shingles and awkward pounding in of the nail.

To remove an installed prior art roof jack, the bottom of each jack if first hit upward with a hammer, pushing the roof jack up, along the path defined by its mounting groove. Once the nail is free of the groove, the roof jack may be fully removed and the nail hammered in. The resulting nail and nail hole compromises water-sealing integrity of the roof. In addition, it is common for the repeated installation and removal of roof jacks to damage shingles, puncture roof membranes, and de-laminate roof components (including shingles, membranes, etc.) with bending-back of shingles, hammering of each roof jack, forceful hammering in (and potential extraction) of nails, and the like.

The art has not demonstrated a satisfactory attachment device for a roof jack which reduces or eliminates damage to roof components. This invention meets that very need.

SUMMARY OF THE INVENTION

Generally, the disclosed invention is directed to a roof jack foot clip that easily installs (without nails or screws) into and between the slants of a roof working area for individualized placement of a worker's boot thereon. This invention does NOT require the situating of multiple clips/stands and the placement of a board or other plank there between. Nor does the removal (and relocation) of the clip/clamp to its next work area cause any undue damage to the roof and/or new roofing materials being installed on the sloped roof surface.

Currently shown versions of these clips depict a front tip notched inwardly from both sides. That may or may not be necessary or preferred. In production, however, it will be desired that each clip have an aperture or hook latch so that a plurality of clips may be carried on a common hook, wire, carabiner or the like for removing and using as needed. Furthermore, the backside interior (closest to the roof boards) and/or boot resting regions of each clip may be coated with rubber or another slip-resistant material for enhanced safety use of these clips in other than ideal (dry) conditions.

BRIEF DESCRIPTION OF THE DRAWINGS

Preferred embodiments of the invention are described in detail below with reference to the attached drawings and photographs in which.

DESCRIPTION OF PREFERRED EMBODIMENTS

The following detailed description is for the purpose of illustrating currently preferred embodiments of this invention. Other embodiments are still possible without deviating from the spirit and scope hereof. The accompanying drawings and particular elements discussed below use terms meant as examples and not as limitations. Functions equivalent to those illustrated in the photographs may be provided by still other device(s) or structure(s).

As used herein, "releasably attachable" and "releasably connectable" are understood to be equivalent; "attach" and "connect" (and "attachable" and "connectable") are also understood to be equivalent; and "releasable," "releasably," "releasably attachable," and/or "releasably connectable" are understood to mean being able to be repeatedly connected/disconnected (or engaged/disengaged) through the use of hands, feet, or human appendage, with application of human-scale work effort, not generally requiring the use of a tool let alone any special or customized tool/tooling.

Figure 1:
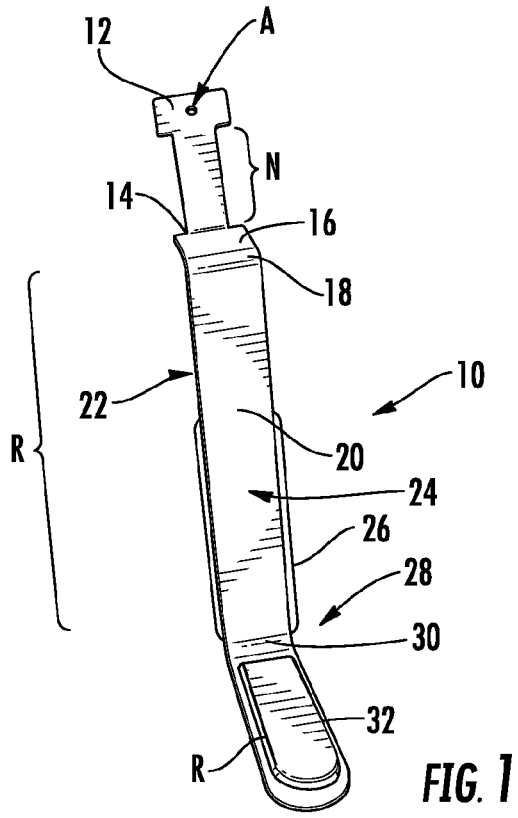
FIG. 1 is a top perspective view of one embodiment of roof jack clip according to this invention.
Figure 2:
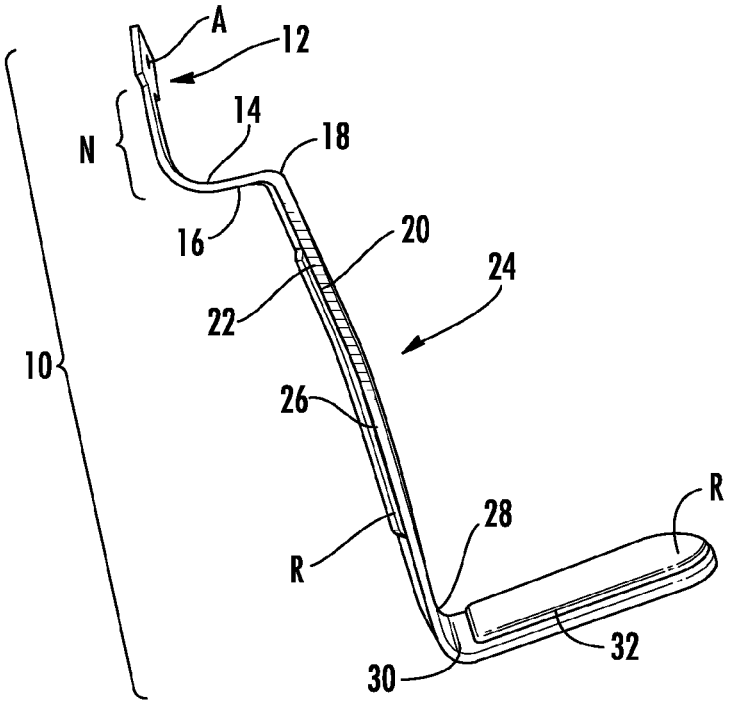
FIG. 2 is a side perspective view of the roof jack clip from FIG. 1.

FIGS. 1 and 2 are full views of a representative roof jack clip 10 before it is used/installed between the boards of a roof for old shingle removal and/or new shingle installation. Clip 10 consists of an uppermost tip 12, a first elbow bend 14, a short flat portion 16 followed by a second elbow 18 that bends in an opposite direction from first elbow bend 14.

Thereafter, the clip 10 includes an elongated flat shaft component 20 whose back end 22 is meant to sit adjacent the roof boards when the jack clip is properly installed therebetween. As better seen in FIG. 2, a midsection 24 of flat shaft component 20 can be structurally strengthened (for holding greater user weights) by welding one or more reinforcement segments 26 thereto.

At the lowermost end 28 of flat shaft component 20, there is provided yet another elbow bend 30 (which preferably extends substantially parallel with/to first elbow bend 14) before the whole clip 10 terminates in a "shelf-like" user boot support portion 32.

The foregoing clip 10 leads to a pre-shaped, pre-stressed clip that somewhat resembles a lightning bolt in its zigzag, jagged design . . . but each of the pre-set folds serves a special purpose: the top folds for assisting with clip installation between adjacent roof boards B1, B2 before being hinged or "flipped" downwardly against the main surface of the lower of those two adjacent roof boards B2. Thereafter, the user can safely rest his or her work boot W on the latter, outwardly folded and extending boot rest shelf portion/component 32.

More preferred embodiments will include rubberized coating treatments R to the exterior flat shelf component that otherwise extends adjacent the roof boards. A similar coating treatment of a non-slippery material to the upside of the boot resting shelf will also further enhance user safety especially in potentially moist conditions (i.e., from the elements—rain, drizzle, fog, etc. or from the sweat and/or spilled drinks of the workers atop a hot roof in mid summer).

Yet another preferred addition (not currently shown) is the incorporation of one or more apertures A and/or hook elements into the body proper of each and every clip, most preferably in a common standard area/recess or the like. Such a common coordination would allow for a plurality of such clips to be commonly connected (on a wire, cord, even a large carabiner) for each user to transport up a ladder (or scaffolding) and onto the roof for in situ installations as needed.

The main elbow bends of the clip proper are meant to extend substantially perpendicular or at mostly a ninety degree angle relative to the next adjoining clip component. That is most critical toward the bottom end of each clip. The first elbow bend may be less than or greater than 90 degrees and still accomplish the main goals of same, i.e., assisting with initial installation of the respective clips and, after proper use of same, the removal of the clip for reuse at another installation section of the same roof job.

The preferred embodiment depicted has representative measurements of about 1.5 to 2 inches for the first section length, 1 inch for the short flat portion, about 8 to 10 inches for the flat shaft region ending in a boot shelf component about 5 to 6 inches long. Overall, the total length for each clip, from top to bottom, measures between about 14 to 16 inches. The width of this clip is a consistent 1.5 inches as variations in sectional lengths may interfere with the clip laying flat against the pitched roof when properly installed.

The components to the aforesaid clip may be made of or from a wide range of materials non-exclusively including aluminum, steel, iron, copper, tin and alloys between and including these and other materials, as well as and/or including composites such as fiberglass, aramid, carbon-fiber, an other fibers combined with resin and/or epoxy. When made from cast iron components (for enhanced strength), the resultant clip will weigh roughly 8 to 14 ounces each.

Figure 3:
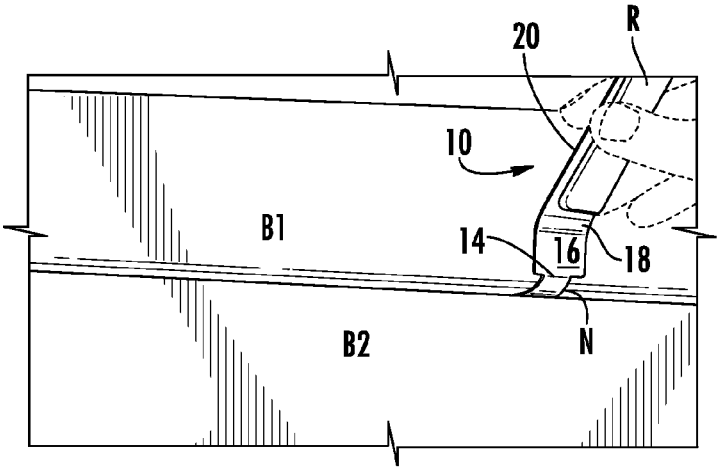
FIG. 3 is a rear perspective view showing the FIG. 1 clip at the start of its insertion between representative roof boards for illustration purposes.
Figure 4:
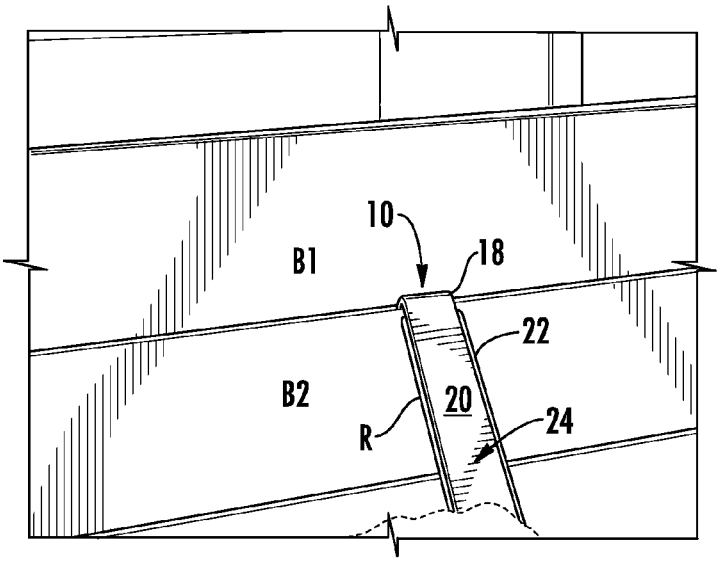
FIG. 4 is a rear perspective view showing the clip from FIG. 3 fully inserted between adjacent roof boards.

FIGS. 3 through 8 show the sequential installation of one such clip between adjacent roof boards according to the present invention. Particularly, there is the initial insertion of the clip tip 12 into the gap between adjacent boards B1, B2 as seen in FIG. 3. Though not required in subsequent embodiments, the two inward notches N, roughly 2 inches down from the top end of clip 10 provide some indication of how far in to insert the clip head between adjoining roof boards.

Figure 5:
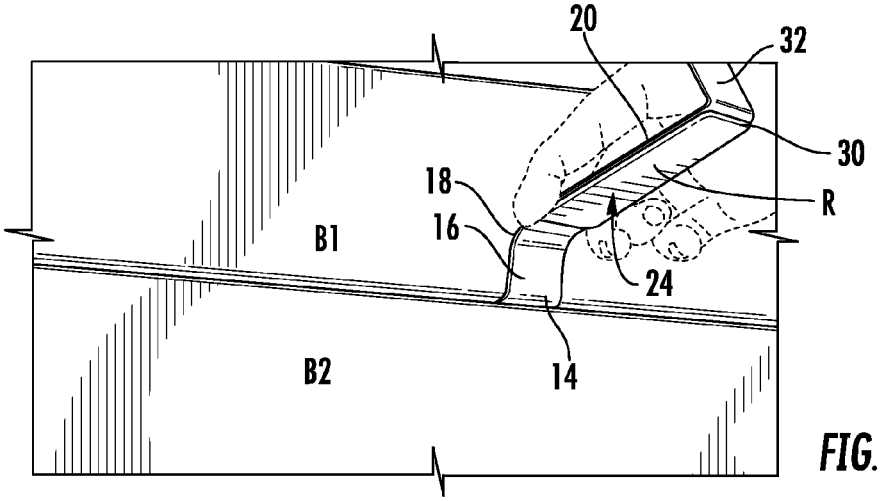
FIG. 5 is a rear perspective view showing the start of the clip from FIG. 4 being hinged or folded down after its full forward insertion between adjacent roof boards.
Figure 6:
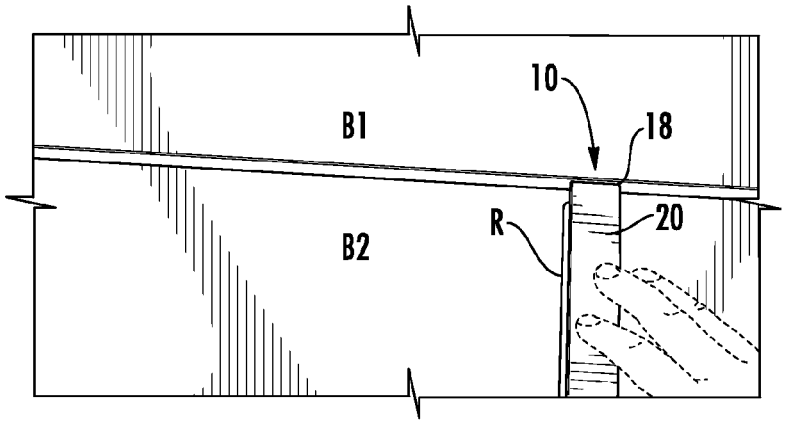
FIG. 6 is a rear perspective view showing the top half of the clip from FIG. 5 completely folded down between adjacent roof boards.
Figure 7:
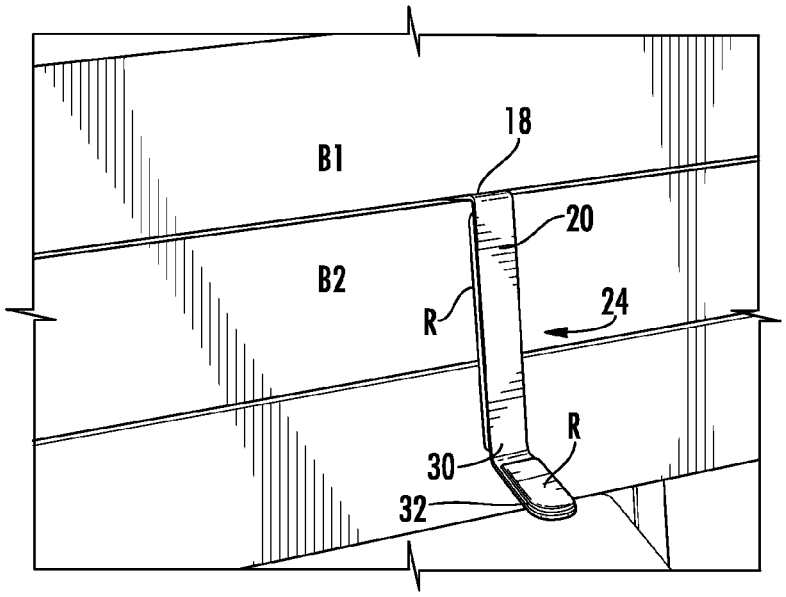
FIG. 7 is an upper front view of a fully installed clip between adjacent roof boards according to this invention.
Figure 8:
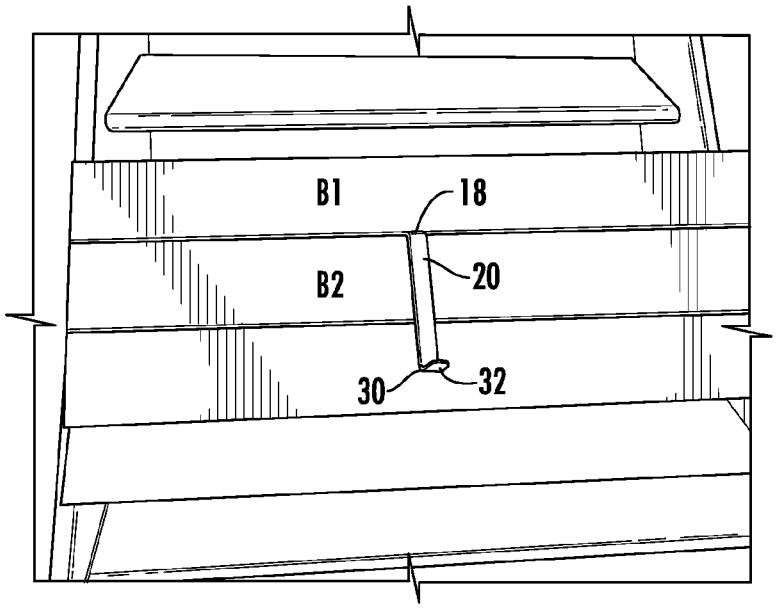
FIG. 8 is a more "straight on" perspective view of the fully installed clip from FIG. 7.

Once inserted a proper distance inwardly between two adjoining roof boards (as per FIG. 4), the whole of the clip may next be flipped down as shown in the first stage of flipping at FIG. 5 until fully "at rest" against roof board B2. FIG. 6 shows the clip 10 after flipping has been completed. Finally, FIGS. 7 and 8 show the fully installed clip, in place, and ready for use, from two perspectives/angles.

Figure 9:
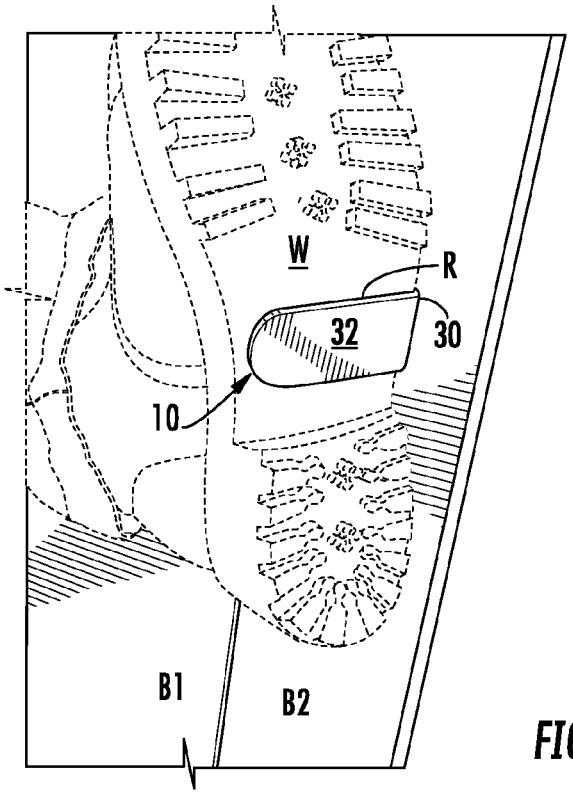
FIG. 9 is a close up, bottom view of a clip user's boot resting on the fully installed embodiment from FIGS. 7 and 8.
Figure 10:
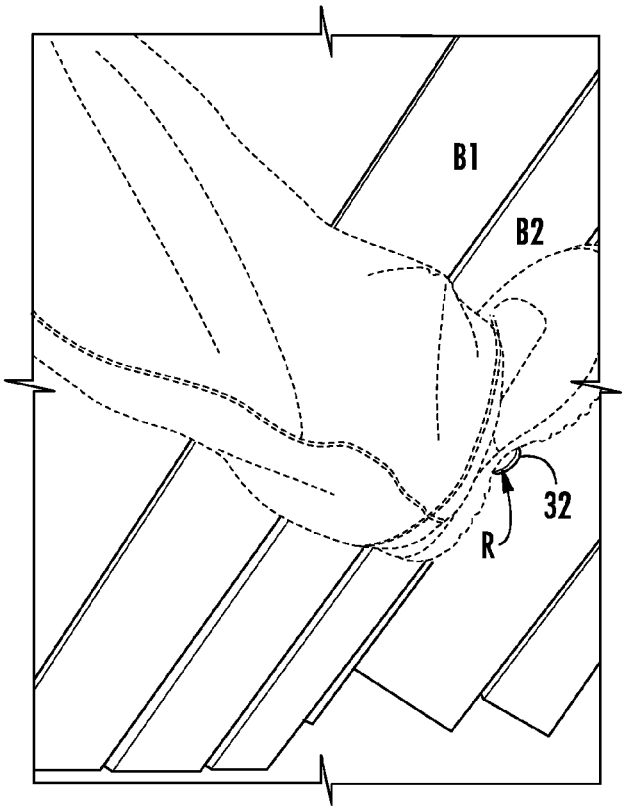
FIG. 10 is a top perspective view of the user's boot covering the fully installed clip from FIG. 9.

Next, FIGS. 9 and 10 show the work boots W of a user stepping onto the shelf-like boot support component 32 of a properly installed roof jack clip 10. The clip itself is still visible in FIG. 9 while the whole leg weight of its user rests on that clip shelf 32 to support him as per the top view at FIG. 10.

What is claimed is:

1. A method for supporting an installer on a sloped set of roof boards without having to use repeated board platforms, said method comprising the steps of:

(a) providing a plurality of cast iron roof jack clips, each clip weighing between about 8 to 14 ounces and comprising:
  an uppermost tip which is substantially T-shaped,
  a 90 degree first elbow bend,
  a short flat planar portion,
  a second 90 degree elbow that bends in an opposite direction from the first elbow bend,
  an elongated flat shaft component the back end of which is adapted for resting on and against a roof board when the jack clip is fully installed between adjacent roof boards;
  a third 90 degree elbow bend; and
  a shelf-like boot support portion;

(b) installing a first pair of roof jack clips between adjacent roof boards in a first area of roof repair;

(c) standing on the installed pair of roof jack clips to work in the first area of roof repair without having to use any board platforms therewith;

(d) removing the first pair of roof jack clips from between adjacent roof boards in the first area of roof repair;

(e) installing a second pair of roof jack clips between adjacent roof boards in a second area of roof repair; and (f) standing on the installed second pair of roof jack clips to work in the second area of roof repair without having to use any board platforms therewith.

2. The method of claim 1 wherein each cast iron roof jack clip has a slip-resistant coating applied to at least one of: the back end of the elongated flat shaft component and an inside, uppermost edge of the shelf-like user boot support portion.

3. The method of claim 1 wherein each cast iron roof jack clip has at least one aperture for storing on a ring, clip or wire when not in use.

* * * * *